United States Patent [19]

Herzog

[11] 4,419,647

[45] Dec. 6, 1983

[54] LIQUID-COOLED TRANSFORMER FOR LARGE POWER RATINGS

[75] Inventor: Max Herzog, Stuttgart, Fed. Rep. of Germany

[73] Assignee: Transformatoren Union Aktiengesellschaft, Stuttgart, Fed. Rep. of Germany

[21] Appl. No.: 247,813

[22] Filed: Mar. 26, 1981

[30] Foreign Application Priority Data

Mar. 31, 1980 [DE] Fed. Rep. of Germany ..... 3012550

[51] Int. Cl.[3] ..... H01F 27/02

[52] U.S. Cl. ..... 336/92; 336/100; 336/210; 361/333

[58] Field of Search ..... 336/100, 92, 90, 94, 336/65, 55, 57, 58, 210; 361/333

[56] References Cited

U.S. PATENT DOCUMENTS

| | | | |
|---|---|---|---|
| 3,125,736 | 3/1964 | Aronson et al. | 336/92 X |
| 3,175,174 | 3/1965 | Simmons | 336/100 |
| 3,312,920 | 4/1967 | Twomey | 336/100 |
| 3,344,381 | 9/1967 | Keepke | 336/92 |
| 3,474,369 | 10/1969 | Keogh | 336/92 X |
| 3,792,397 | 2/1974 | Reinemann | 336/92 |

*Primary Examiner*—Thomas J. Kozma

*Attorney, Agent, or Firm*—Herbert L. Lerner; Laurence A. Greenberg

[57] ABSTRACT

Liquid-cooled transformer for large power ratings, including a tank having a bottom with cutouts formed therein, large-area base plates resting on the bottom of the tank, an active part having ends and a pressure device being fastened to the base plates, at least one of the base plates being disposed under one of the ends of the active part, the at least one base plate having outside corners being disposed above the cutouts formed in the tank bottom, stopping blocks positively locking the outside corners in position without play, and inserts supporting the stopping blocks and oil tightly closing off the cutouts.

5 Claims, 3 Drawing Figures

LIQUID-COOLED TRANSFORMER FOR LARGE POWER RATINGS

The invention relates to a liquid-cooled transformer for large power ratings with an active part mounted in a tank, where the active part is fastened with its pressure device on large-area base plates resting on the bottom of the tank.

In such transformers, horizontal relative motion between the active part and the tank can occur during transport or due to earthquakes. For suppressing these motions of the active part, screw connections from the active part to angle brackets or blocks fastened at the bottom of the tank have customarily been used heretofore. These screw connections, however, require a considerable construction and manufacturing effort, because of their large dimensions and the large openings required for accessibility.

It is accordingly an object of the invention to provide a liquid-cooled transformer for large power ratings, which overcomes the hereinafore-mentioned disadvantages of the heretofore-known devices of this general type for locking the active part of a transformer in the associated tank, with an arrangement which ensures clamping of the active part without play, that is effective up to the largest forces.

With the foregoing and other objects in view there is provided, in accordance with the invention, a liquid-cooled transformer for large power ratings, comprising a tank having a bottom with cutouts formed therein, large-area base plates resting on the bottom of the tank, an active part having ends and a pressure device being fastened to the base plates, at least one of the base plates being disposed under one of the ends of the active part, the at least one base plate having outside corners, as seen in the longitudinal direction of the active part, being disposed above the cutouts formed in the tank bottom, stopping blocks positively locking the outside corners in position without play, and inserts supporting the stopping blocks and oil tightly closing off the cutouts.

Advantageously, the restrained corners of the base plates are recessed and are supported in the longitudinal and transverse direction on the corresponding stopping blocks with the edges which are created thereby, and form an internal angle.

Therefore, in accordance with another feature of the invention, the outside restrained corners of the base plates have recesses formed therein, the recesses forming edges and corners with inside angles for supporting the base plates in the longitudinal and transverse directions on the stopping blocks.

In accordance with a further feature of the invention, the inserts are welded to the stopping blocks and the tank bottom.

In accordance with an added feature of the invention, there are provided additional shock absorbing blocks disposed between the outside restrained corners and the stopping blocks.

In accordance with an additional feature of the invention, the stopping-blocks are made from a greatly different material than the tank bottom and base plates, at least as far as its modules of elasticity is concerned.

In accordance with a concomitant feature of the invention, the outside corners of the base plates define upper edges, and there are provided edge beads on the stopping blocks disposed above the upper edges for vertically holding the stopping blocks.

The arrangement according to the invention is very advantageous because it is simple and can be adapted by simple variations of the dimensions to any load condition. In addition, substantially higher load values can be managed than with the arrangements which were customary heretofore, so that transport action can also be effected under very unfavorable conditions, and on the other hand the installation of these transformers in earthquake zones is possible without reservation.

Other features which are considered as characteristic for the invention are set forth in the appended claims.

Although the invention is illustrated and described herein as embodied in a liquid-cooled transformer for large power ratings, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
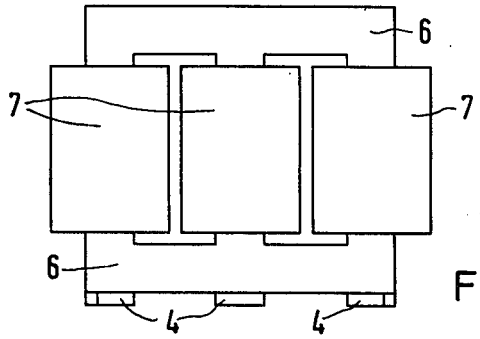
FIG. 1 is a diagrammatic front elevational view of the active part of a transformer.

Referring now to the figures of the drawing and first particularly to FIG. 1 thereof, there is shown the transformer's active part prior to its installation in a transformer tank. This active part of the transformer substantially includes a three-legged core 6 and winding 7.

Figure 2:
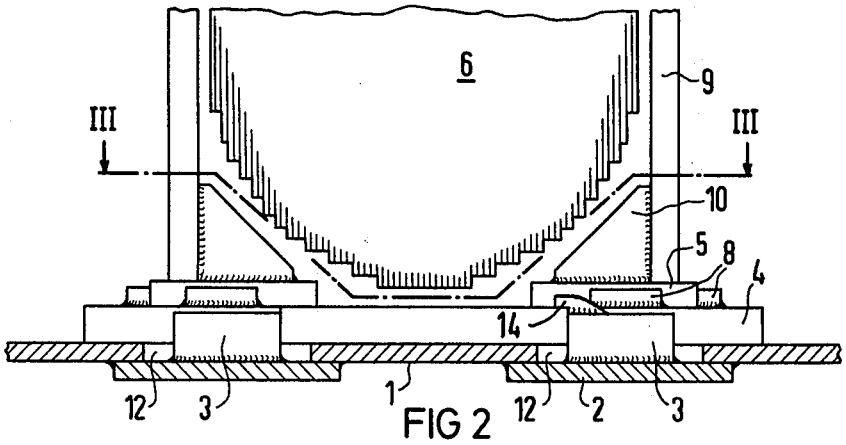
FIG. 2 is an enlarged, fragmentary partially cross-sectional view taken along the line II—II in FIG. 3 in the direction of the arrow.
Figure 3:
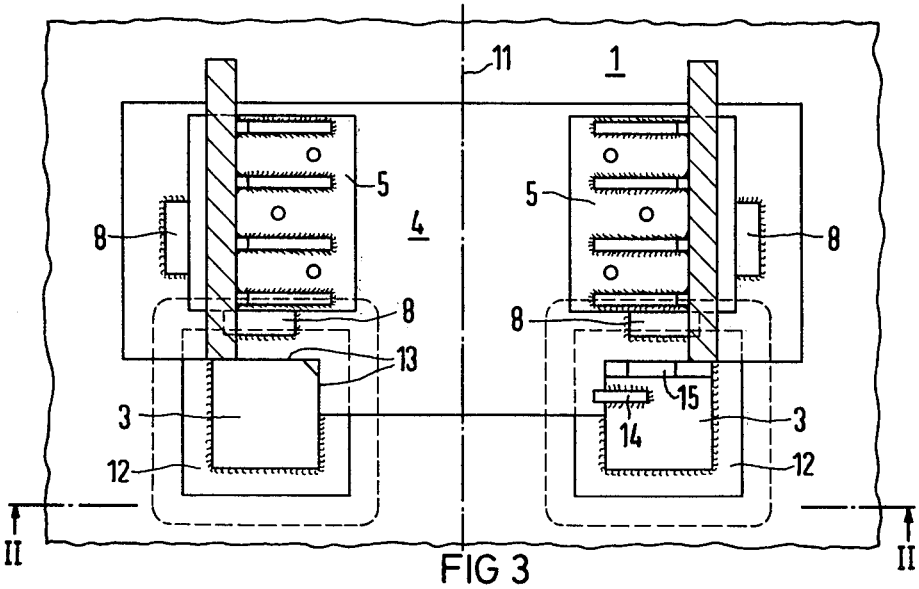
FIG. 3 is a fragmentary partially cross-sectional view taken along the line III—III in FIG. 2, in the direction of the arrows.

Utilizing a frame that is not shown in detail in FIG. 1 for compressing the core 6 of stacked laminations and the windings 7, base plates 4 are fastened under the lower yoke of the core 6. These base plates 4 transmit all vertical and horizontal forces between the active part of the transformer and the transformer tank surrounding the active part. Referring to FIGS. 2 and 3, the frame of the active part which is not shown in detail, is fastened with its feet 5 to the base plates 4 in a known manner by using threaded bolts, and is secured against lateral shifting on the base plates 4 by bars 8 welded to the base plates. In addition, the feet 5 may also be welded directly to the base plate 4. The forces coming from the active part are introduced into the feet 5 through the lower ends of tension cover plates 9 and reinforcement angle brackets 10 which are welded to the feet 5.

After the active part of the transformer is inserted, the base plates 4 rest directly on a tank bottom 1. The outside corners of the base plates 4 (as seen in the direction of the longitudinal axis 11 of the transformer) disposed under the ends of the active part lie over cutouts 12 formed in the tank bottom 1. These corners of the base plates 4 are recessed and form an inside angle with their edges 13 as shown in FIG. 3. When the active part is inserted into the tank, the base plates 4 are aligned on the tank bottom 1 in such a manner that the inside angles formed by the edges 13 are situated approximately uniformly over the cutouts 12.

Then, a stopping block 3 supported by an insert 2 is pushed on the outside of the assembly from below through each of the cutouts 12 into the angle formed by the edges 13. The stopping blocks 3 had been previously firmly joined to the corresponding insert 2 such as by welding. After the correct position of the active part in the tank has been checked, the inserts 2 are then welded oil-tightly under the cutouts 12. The stopping blocks 3 are therefore held at the edges 13 in the recessed corners of the base plate 4.

Through this arrangement, the base plates 4 are fastened on the bottom of the tank 1 without play in such a manner that even large horizontal forces can be transmitted securely. Such forces can occur, for instance, through shocks in transport or during earthquakes. Additional shock absorber blocks may be disposed between the corners and the stopping blocks 3 for this purpose.

For transmitting larger vertical forces between the base plate 4 and the bottom of the tank, particularly for preventing the base plates 4 from being lifted off the tank bottom 1, the stopping blocks 3 may be provided, as shown in FIGS. 2 and 3, with edge beads 14 engaging over the base plate 4 and can therefore also produce positive engagement in the vertical direction.

There is claimed:

1. Liquid-cooled transformer for large power ratings, comprising a tank having a bottom with cutouts formed therein, large-area base plates resting on said bottom of said tank, an active part having ends and being mounted in said tank, a pressure device, and means for positively locking said active part and said pressure device to said base plates without play, said base plates being disposed under one of said ends of said active part, said at least one base plate having corners including outside corners as seen in longitudinal direction of said active part, at least said outside corners being disposed above said cutouts formed in said tank bottom, said locking means including stopping blocks having a shape matched to said base plate positively locking said outside corners in position without play, said outside corners of said base plates having recesses formed therein, said recesses forming corners with inside angles for supporting said base plates in the longitudinal and transverse directions on said stopping blocks, and said locking means including inserts supporting said stopping blocks and oil tightly closing off said cutouts.

2. Liquid-cooled transformer according to claim 1, wherein said inserts are welded to said stopping blocks and said tank bottom.

3. Liquid-cooled transformer according to claim 1, including additional shock absorbing blocks disposed between said outside corners and said stopping blocks.

4. Liquid-cooled transformer according to claim 1, wherein said stopping blocks are made from a different material than said tank bottom and base plates, at least as far as its modulus of elasticity is concerned.

5. Liquid-cooled transformer according to claim 1, wherein said outside corners of said base plates define edges, and including edge beads on said stopping blocks disposed above said edges for vertically holding said stopping blocks.

* * * * *